US007704081B2

(12) United States Patent
Swanger et al.

(10) Patent No.: US 7,704,081 B2
(45) Date of Patent: Apr. 27, 2010

(54) ELECTRICAL CONNECTOR HAVING SIGNAL AND POWER CONTACTS

(75) Inventors: Nathan William Swanger, Mechanicsburg, PA (US); Justin Shane McClellan, Camp Hill, PA (US); Daniel L. Gorenc, Harrisburg, PA (US); Richard Elof Hamner, Hummelstown, PA (US); Jason M'Cheyne Reisinger, Carlisle, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/271,153

(22) Filed: Nov. 14, 2008

(65) Prior Publication Data

US 2009/0137157 A1 May 28, 2009

Related U.S. Application Data

(60) Provisional application No. 61/004,593, filed on Nov. 28, 2007.

(51) Int. Cl.
*H01R 12/00* (2006.01)

(52) U.S. Cl. ..... 439/79; 439/607.07

(58) Field of Classification Search ..... 439/79, 439/607.07, 607.08, 607.09, 607.11, 607.13, 439/607.26, 607.35, 607.36, 607.37, 607.38, 439/607.4

See application file for complete search history.

(56) References Cited

U.S. PATENT DOCUMENTS

| | | | | |
|---|---|---|---|---|
| 6,755,689 | B2 * | 6/2004 | Zhang et al. | 439/607.01 |
| 6,863,546 | B2 * | 3/2005 | Yang et al. | 439/79 |
| 6,962,510 | B1 * | 11/2005 | Chen et al. | 439/660 |
| 7,160,120 | B2 * | 1/2007 | Zhang et al. | 439/79 |
| 7,559,805 | B1 * | 7/2009 | Yi et al. | 439/660 |

* cited by examiner

*Primary Examiner*—Thanh-Tam T Le

(57) ABSTRACT

An electrical connector includes a dielectric housing having a tongue including an upper surface, a lower surface, and opposite side surfaces. A plurality of signal contacts are held by the housing and are exposed along the upper surface. At least one power contact is held by the housing and is exposed along one of the opposite side surfaces. Optionally, the tongue and signal contacts define an eSATA mating interface configured for mating with a plug of a serial cable defining an eSATA plug interface.

21 Claims, 6 Drawing Sheets

ELECTRICAL CONNECTOR HAVING SIGNAL AND POWER CONTACTS

CROSS REFERENCE TO RELATED APPLICATIONS

This application claims the benefit of U.S. Provisional Application No. 61/004,593 filed Nov. 28, 2007, the subject matter of which is herein incorporated by reference in its entirety.

BACKGROUND OF THE INVENTION

The subject matter herein relates generally to an electrical connector having signal and power contacts, and more particularly to an electrical connector having a tongue and an array of contacts on a periphery of the tongue.

Electrical connectors that comply with the Serial Advanced Technology Attachment (SATA) standard are known. These connectors provide input/output connections for data storage devices in computer assemblies. There is a special connector (eSATA) specified for external data storage devices, and eSATA connectors are also known. These eSATA connectors include a housing having a tongue and contacts arrayed along one surface of the tongue. The contacts include signal contacts and ground contacts.

Computers and external data storage devices using known eSATA connectors are not without disadvantages. For instance, the external data storage devices typically require power to the device. Separate power connections are provided to the external data storage device in addition to the data connection provided by the eSATA connectors. The power is usually provided by an external power connector or a USB connector. Provision of multiple connectors to the external storage device complicates the interconnection and usability of such devices.

There is a need for a data and power connector for external data storage devices that can be accomplished in a simplified manner. There is a need to add power contacts to an eSATA connector without changing the physical dimensions of the connector.

BRIEF DESCRIPTION OF THE INVENTION

In one embodiment, an electrical connector is provided that includes a dielectric housing having a tongue including an upper surface, a lower surface, and opposite side surfaces. A plurality of signal contacts are held by the housing and are exposed along the upper surface. At least one power contact is held by the housing and is exposed along one of the opposite side surfaces. Optionally, the tongue and signal contacts define an eSATA mating interface configured for mating with a plug of a serial cable defining an eSATA plug interface.

Optionally, each power contact may be oriented non-coplanar with respect to the signal contacts. Each power contact may include a mating surface arranged substantially flush with the corresponding side surface. Optionally, the tongue may have a width measured between the opposed side surfaces. A first power contact may be arranged on one of the side surfaces and a second power contact may be arranged on the other side surface with the exposed portions of the first and second power contacts being separated by a distance substantially equal to the width of the tongue.

In another embodiment, an electrical connector is provided for mating with a serial cable associated with an external data storage device, where the serial cable has one or more data conductors and one or more power conductors. The data conductors are configured to transmit data to the external data storage device and the power conductors are configured to transmit power to the external data storage device. The electrical connector includes a dielectric housing having a tongue including a plurality of surfaces and signal contacts exposed along one of the surfaces of the tongue. The signal contacts are configured to be electrically connected to the data conductors of the serial cable. A power contact is exposed along a different surface of the tongue, where the power contact is configured to be electrically connected to the power conductor of the serial cable to power the external data storage device. A metallic shell surrounds at least a portion of the housing and the shell is configured to engage a portion of the serial cable.

In a further embodiment, an electrical connector is provided that includes a dielectric housing having a base configured to be mounted to a circuit board. The housing has a main wall extending from the base and a tongue extending from the main wall. The tongue has an upper surface that is generally planar and oriented substantially parallel to the base, and the tongue has side surfaces that are generally perpendicular to the upper surface. The main wall has a plurality of cavities extending therethrough. A plurality of signal contacts are held by the housing within corresponding cavities and are exposed along the upper surface. At least one power contact is held by the housing within corresponding cavities and is exposed along one of the opposite side surfaces.

DETAILED DESCRIPTION OF THE INVENTION

Figure 1:
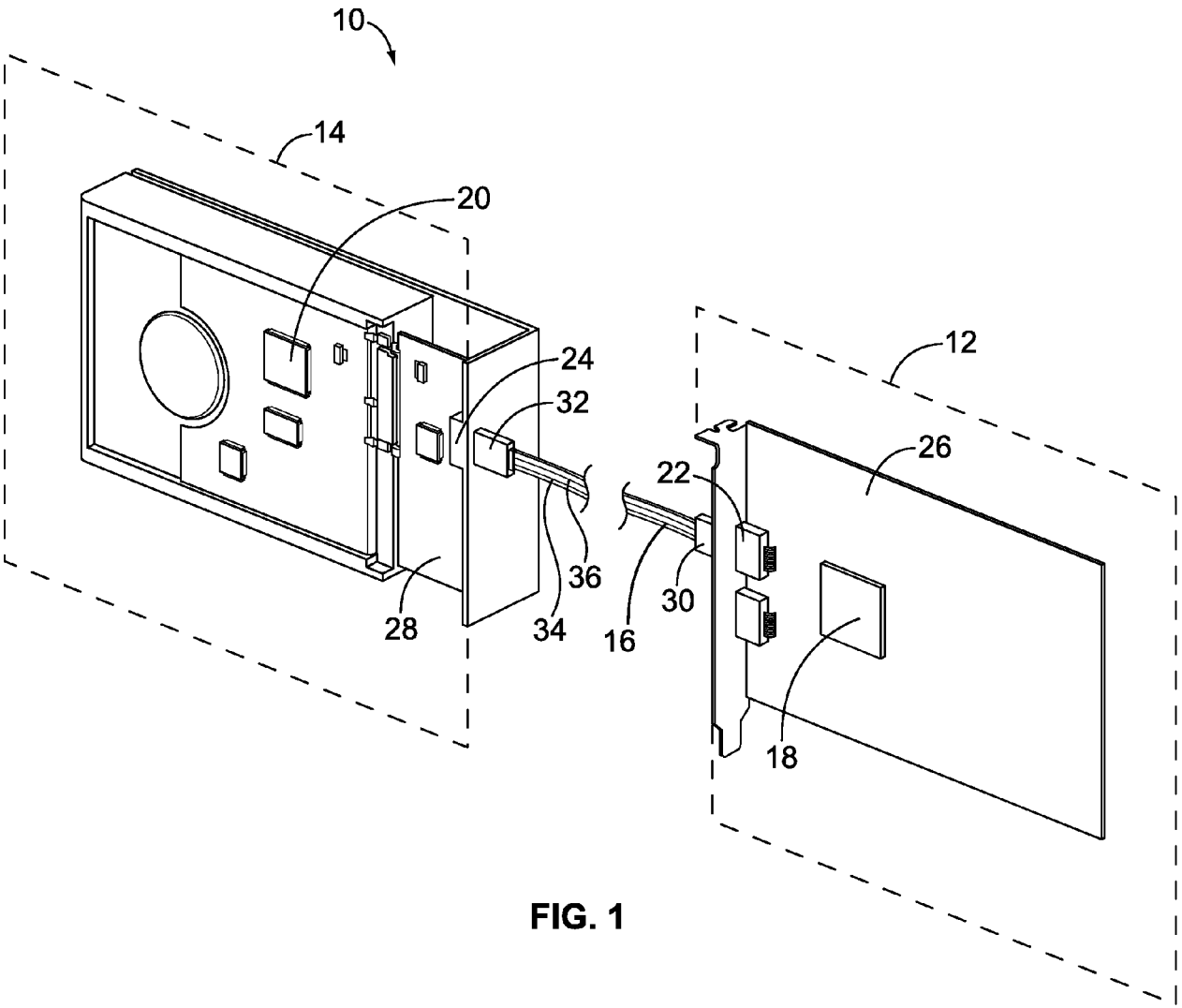
FIG. 1 is schematic illustration of an electronic system utilizing an electrical connector according to an exemplary embodiment.

FIG. 1 is schematic illustration of an electronic system 10 having a first electronic device 12 connected to a second electronic device 14 by a cable 16. In the illustrated embodiment, the first electronic device 12 is represented by a computer and the second electronic device 14 is represented by an external data storage device. The first electronic device 12 includes one or more components 18, such as microprocessors, memories, and the like. The second electronic device 14 similarly includes one or more components 20, such as microprocessors, memories, and the like.

The first electronic device 12 includes an electrical connector 22 for interfacing with the cable 16. Similarly, the second electronic device 12 includes an electrical connector 24 for interfacing with the cable 16. The electrical connectors 22, 24 may be the same type of electrical connector, or alternatively may be different from one another. In the illustrated embodiment, the electrical connectors 22, 24 constitute eSATA connectors, however other types of connectors may be used in alternative embodiments.

The electrical connector 22 is mounted to a circuit board 26 of the first electronic device 12. The components 18 may be directly mounted to the circuit board 26, or alternatively may be electrically connected thereto such as by using connectors. Similarly, the electrical connector 24 is mounted to a circuit board 28 or the second electronic device 14. The components 20 may be electrically connected to the circuit board 28.

The cable 16 is represented in FIG. 1 by a high-speed serial cable having plugs 30, 32 at the ends of the cable 16. The plugs 30, 32 have mating interfaces that complement the electrical connectors 22, 24, respectively. In an exemplary embodiment, the plugs 30, 32 have mating interfaces that define eSATA connectors. The cable 16 includes one or more data conductors 34 extending between the plugs 30, 32. The data conductors 34 are electrically connected to the connectors 22, 24 for transmitting data therebetween. In an exemplary embodiment, the cable 16 includes one or more power conductors 36 extending between the plugs 30, 32. The power conductors 36 are electrically connected to the connectors 22, 24 for transmitting power therebetween. For example, power may be supplied to the first electrical connector 22 of the first electronic device 12 and transmitted via the cable 16 to the second electrical connector 24 of the second electronic device 14 for powering the second electronic device 14. Optionally, the power supplied to the second electronic device 14 may be used to power the one or more components 20 of the second electronic device 14.

Figure 2:
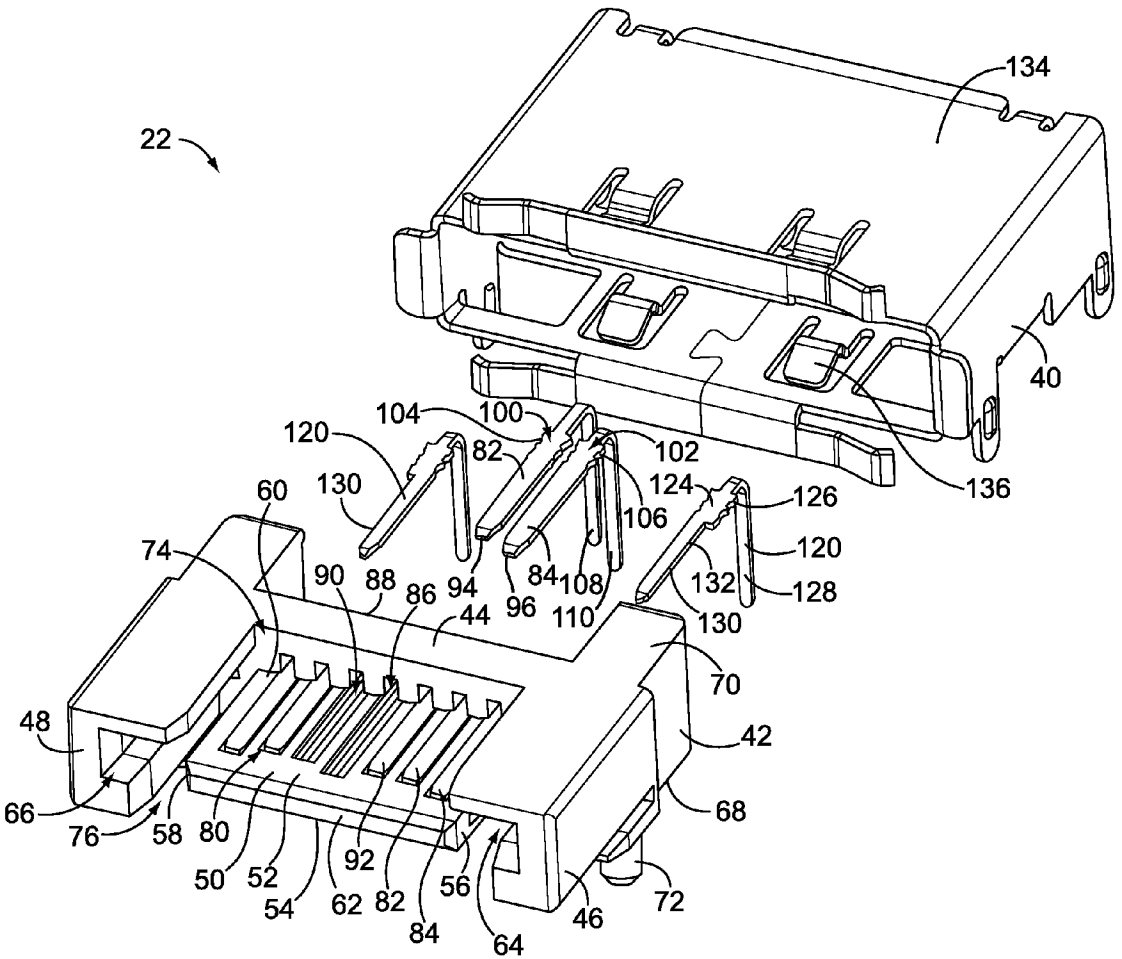
FIG. 2 is an exploded view of the electrical connector shown in FIG. 1, along with an external shield for the connector.

FIG. 2 is an exploded view of the electrical connector 22, along with an external shield 40 for the electrical connector 22. The electrical connector 22 includes a dielectric housing 42 including a main wall 44 and two sidewalls 46, 48. A tongue 50 extends forwardly from the main wall 44. The tongue 50 has an upper surface 52, a lower surface 54, and opposite side surfaces 56, 58. The upper surface 52 is defined as the surface having contacts 80 thereon, and it is realized that the upper Surface 52 may not necessarily be above other surfaces of the tongue depending on the particular mounting configuration of the electrical connector 22. For example, the upper surface 52 may be closer to a base 68 of the housing 42 in some alternative embodiments. The tongue 50 extends from a root end 60 to a front tip 62. Optionally, the front tip 62 may be chamfered. The electrical connector 22 may receive the plug 30 (shown in FIG. 1) at the front such that the front tip 62 of the tongue 50 is received within a portion of the plug 30. The sidewalls 46, 48 may include grooves 64, 66, respectively, that receive a portion of the plug 30 when the plug 30 is mated with the electrical connector 22.

In an exemplary embodiment, the housing 42 includes a base 68 and a top 70 opposite to the base 68. The main wall 44 generally extends between the base 68 and the top 70. The main wall 44 may be oriented generally perpendicular to the base 68 and/or the top 70. In an exemplary embodiment, the tongue 50 extends from the main wall 44 such that the upper surface 52 and/or the lower surface 54 are oriented generally parallel to the base 68 and/or the top 70. The electrical connector 22 may be mounted to the circuit board 26 (shown in FIG. 1) such that the base 68 rests on and/or is supported by the circuit board 26. Optionally, mounting posts 72 may extend from the base 68 for mounting the electrical connector 22 to the circuit board 26. In an exemplary embodiment, the sidewalls 46, 48 may be separated from one another at the base 68 and/or the top 70 to form gaps 74, 76, respectively. The gaps 74, 76 define openings that expose the tongue 50 through the base 68 and/or the top 70.

The housing 42 holds an array of contacts 80 that are exposed along the upper surface 52 of the tongue 50. The array of contacts 80 includes pairs of signal contacts 82 that are separated from each other and flanked by ground contacts 84. FIG. 2 illustrates some of the signal contacts 82 and some of the ground contacts 84 held by the housing 42 and also illustrates one of each of the contacts 82, 84 prior to loading into the housing 42.

The signal contacts 82 and the ground contacts 84 are installed into respective cavities 86 in the housing 42 through a rear surface 88 of the main wall 44. The cavities 86 are aligned with, and open to, channels 90 formed in the tongue 50. Each of the signal and ground contacts 82, 84 are loaded through the cavities 86 into the channels 90. Optionally, the signal and ground contacts 82, 84 are loaded into the channels 90 such that mating surfaces 92 of the signal and ground contacts 82, 84 are generally flush with the upper surface 52 of the tongue 50. In an alternative embodiment, rather than being loaded into the cavities 86, the housing 42 may be overmolded around the contacts 82, 84.

Each of the signal and ground contacts 82, 84 extend to a tip 94, 96, respectively. The tips 94, 96 represent initial mate points of the signal and ground contacts, however, it is realized that the initial mate points may not necessarily be the actual tip of the contacts 82, 84, depending on the particular application and mating process. Optionally, the ground contacts 84 may be oriented within the electrical connector 22 such that the tips 96 of the ground contacts 84 are positioned forward of the tips 94 of the signal contacts 82. The ground contacts 84 may thus be positioned closer to the front tip 62 of the tongue 50. When the plug 30 is mated with the electrical connector 22, the ground contacts 84 mate with corresponding mating contacts (not shown) of the plug 30 prior to the signal contacts 82 of the electrical connector 22 engaging the mating contacts of the plug 30.

Each of the signal and ground contacts 82, 84 includes a retention section 100, 102 having barbs 104, 106 that secure the signal and ground contacts 82, 84 in respective cavities 86 in the main wall 44 of the housing 42. The signal and ground contacts 82, 84 include respective tails 108, 110 generally opposite the tips 94, 96. The tails 108, 110 are received in respective vias or holes of the circuit board 26 on which the electrical connector 22 is mounted.

The electrical connector 22 further includes a pair of power contacts 120 that are exposed along the opposite side surfaces 56, 58 of the connector tongue 50. Similar to the signal and ground contacts 82, 84, the power contacts 120 are installed into respective cavities 122 (shown in FIG. 4) in the housing 42 through the rear surface 88 of the main wall 44. Optionally, the tip, or the initial mate point if other than the tip, of the power contact may be positioned between the tips 94, 96 of the signal and ground contacts 82, 84 such that the ground contact 84 is positioned forward of the power contact 120 and engages with the plug 30 first, and the power contact 120 is positioned forward of the signal contact 82 and engages with the plug 30 before the signal contacts 82 engage the plug 30. As such, the second electronic device 14 (shown in FIG. 1) may be grounded prior to being powered or transmitting data. Additionally, the second electronic device 14 may be powered prior to transmitting data. Each power contact 120 has a retention section 124 with barbs 126 that secure the power contacts 120 in respective cavities 122, and each power contact 120 has a tail 128 that is received in a respective circuit board hole (not shown) for making a power connection to the circuit board 26.

The power contacts 120 are manufactured by stamping and forming sheet material from a blank. Each power contact 120 has an edge 130 that is defined by a thickness of the sheet material from which the power contacts 120 are stamped. The edge 130 of each power contact 120 defines a mating surface 132 for mating with a corresponding power contact (not shown) of the plug 30. That is, the edge 130 is exposed along the respective side surface 56, 58 of the tongue 50 for mating with the power contact in the plug 30. Optionally, the power contacts 120 may be plated prior to installation or assembly.

The electrical connector 22 also includes the external shield 40 in the form of a metallic shell 134. The shell 134 surrounds the housing 42 and the contacts 82, 84, 120. The shell 134 may be electrically and/or mechanically secured to the circuit board 26. In an exemplary embodiment, the shell 134 is grounded to the circuit board 26 and defines a ground shield for the electrical connector 22. The shell 134 generally covers the gaps 74, 76 along the base 68 and/or the top 70. When the plug 30 is mated with the electrical connector 22, the plug 30 may engage the shell 134 to ground the plug 30 to the electrical connector 22. Optionally, the shell 134 may include fingers 136 that engage the plug 30 when the plug 30 is mated with the electrical connector 22.

Figure 3:
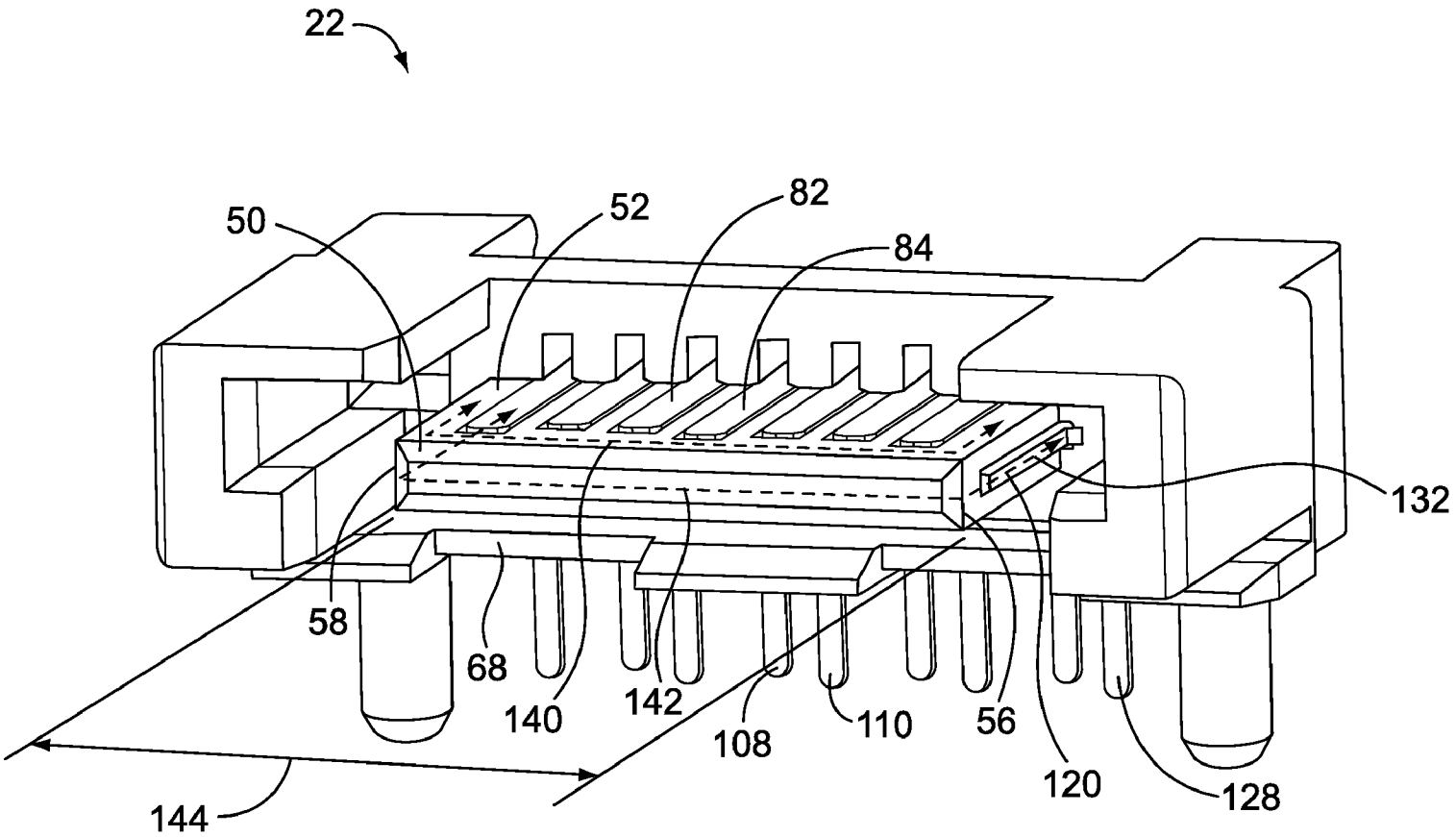
FIG. 3 is an isometric view of the electrical connector shown in FIG. 1.

FIG. 3 is an isometric view of the electrical connector 22 illustrating the signal and ground contacts 82, 84 arranged along the upper surface 52 of the tongue 50. The signal and ground contacts 82, 84 are generally flush with the upper surface 52. The tails 108, 110 of the signal and ground contacts 82, 84 extend below the base 68 for mating with the circuit board 26 (shown in FIG. 1). FIG. 3 also illustrates the power contact 120 arranged along the side surface 56. Another power contact 120 may similarly be arranged along the opposite side surface 58. The power contacts 120 are generally flush with the side surfaces 56, 58. The tails 128 of the power contacts 120 extend below the base 68 for mating with the circuit board 30. In an alternative embodiment, rather than being right angle contacts, the connector may have contacts that pass straight through the housing 42 to mate to a circuit board or directly to wires or a cable.

Each signal contact 82 is arranged along a signal plane 140 generally defined at or near the upper surface 52. The signal plane 140 extends along, and defined by, the signal contacts 82. In the illustrated embodiment, the ground contacts 84 are also arranged along the signal plane 140.

The power contacts 120 are arranged along a power plane 142 defined by the bi-sector of each power contact 120. The power plane 142 is oriented generally along the center of the tongue 50. The power plane 142 is parallel to, and non-coplanar with, the signal plane 140. The power contacts 120 are off-set with respect to the signal and ground contacts 82, 84 to the side surfaces 56, 58 to minimize a width 144 of the tongue 50. For example, the width 144 of the tongue 50 may be selected to accommodate the signal and ground contacts 82, 84 and the provision of the power contacts 120 does not add to the overall width 144. In the illustrated embodiment, the tongue 50 is wide enough to accommodate two pairs of signal contacts 82 with one ground contact 84 between the pairs and one ground contact 84 outside of each of the pairs. It is realized that any number of signal and/or ground contacts 82, 84 may be provided in alternative embodiments, and the signal and ground contacts 82, 84 may be arranged in any pattern of signal and ground contacts.

Figure 4:
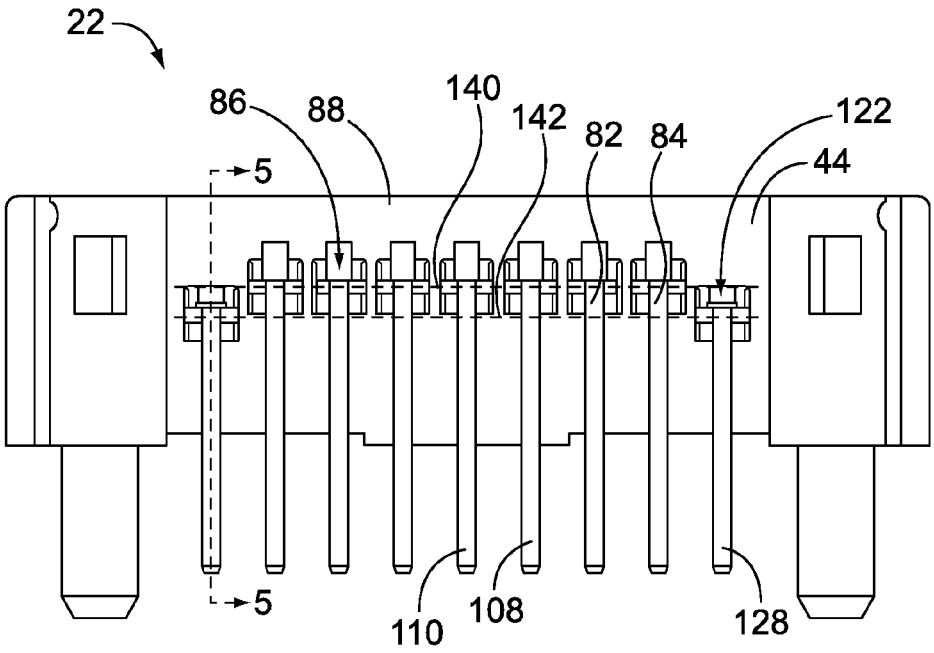
FIG. 4 is rear view of the electrical connector shown in FIG. 1.

FIG. 4 is rear view of the electrical connector 22 illustrating the cavities 86 extending through the rear surface 88 of the main wall 44. The cavities 86 are substantially aligned with one another and hold the signal and ground contacts 82, 84 along the signal plane 140. The cavities 122 holding the power contacts 120 also extend to the rear surface 88 of the main wall 44. The cavities 122 are substantially aligned with one another and hold the power contacts 120 along the power plane 142. The cavities 122 are positioned lower than the cavities 86. In the illustrated embodiment, the tails 108, 110 of the signal and ground contacts 82, 84 have substantially equal lengths such that the bottoms of the tails 108, 110 are aligned with one another. The tails 128 of the power contacts 120 have a length selected such that the bottoms of the tails 128 are aligned with the bottoms of the tails 108, 110 of the signal and ground contacts 82, 84. In alternative embodiments, the tails 108, 110, 128 may have lengths selected such that the bottoms thereof are not aligned with one another.

Figure 5:
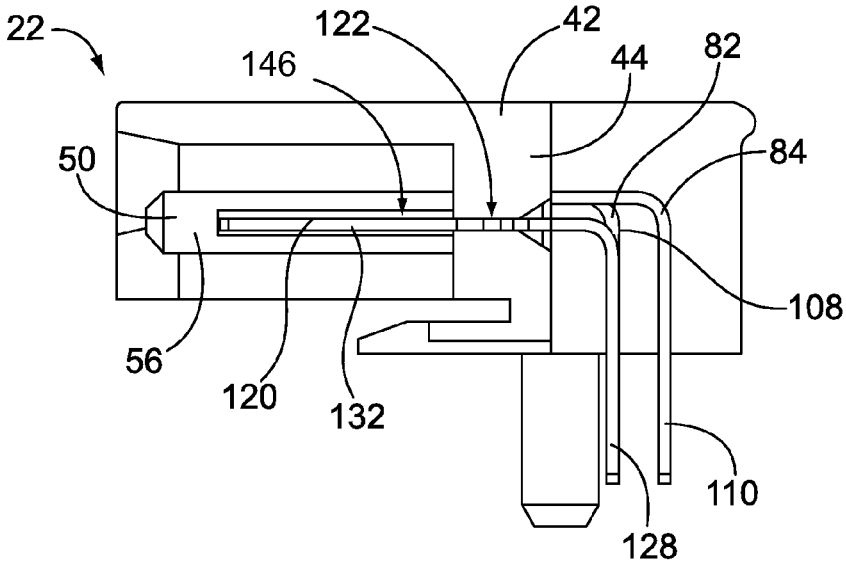
FIG. 5 is a cross-sectional view of the electrical connector taken along line 5-5 in FIG. 4.

FIG. 5 is a cross-sectional view of the electrical connector 22 taken along line 5-5 in FIG. 4 illustrating the power contact 120 held within the housing 42. The cavity 122 extending through the main wall 44 is sized to securely retain the power contact 120 therein. The cavity 122 opens to a channel 146 formed within the side surface 56 of the tongue 50. The channel 146 receives the power contact 120 therein. As such, at least a portion of the power contact 120 may be recessed within the tongue 50 such that the mating surface 132 (shown in FIG. 3) may be oriented generally flush with the side surface 56. FIG. 5 also illustrates that the tails 108, 110, 128 of the contacts 82, 84, 120 are staggered with respect to one another either towards the front or towards the rear of the electrical connector 22.

Figure 6:
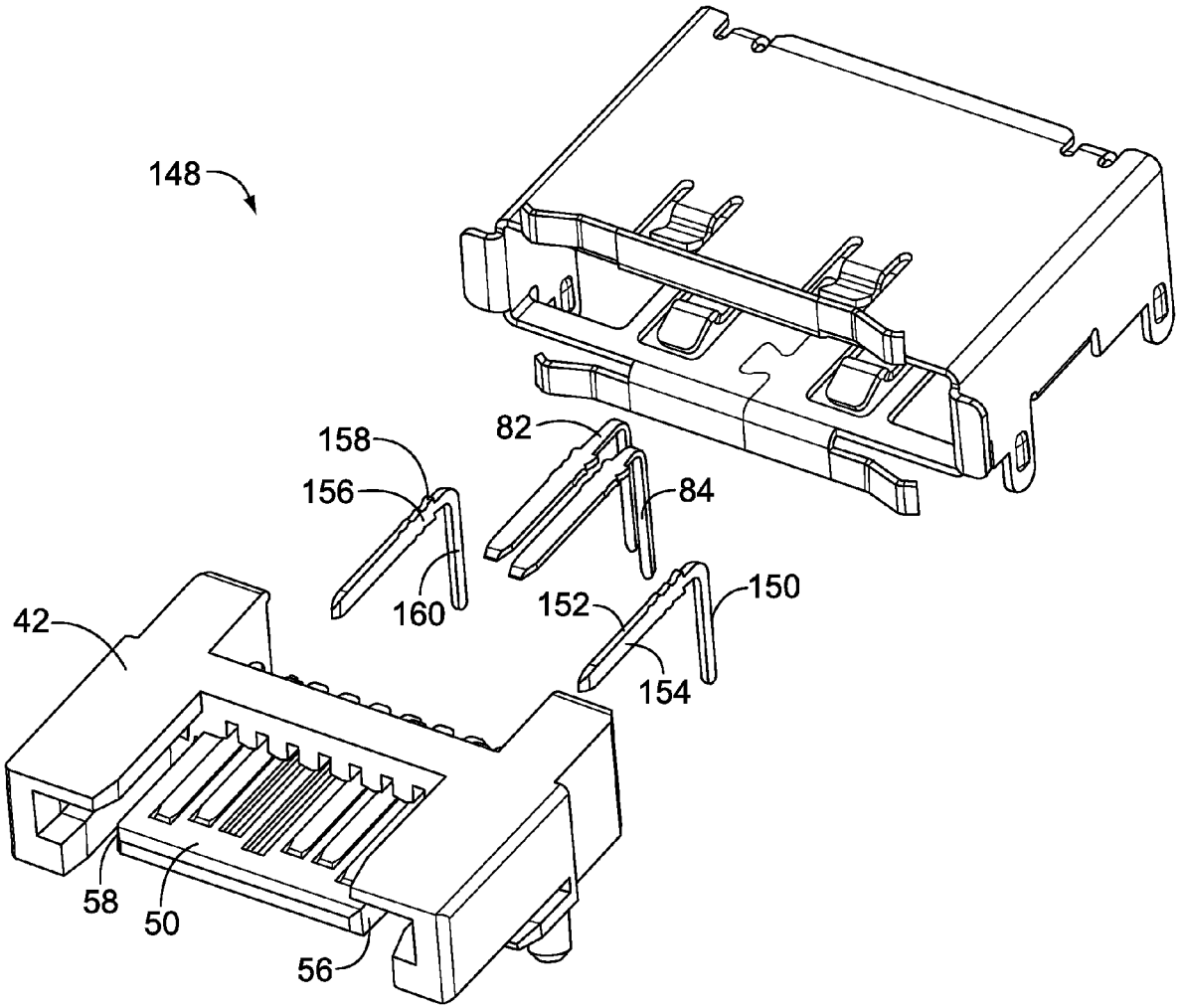
FIG. 6 is an exploded view of an electrical connector according to an alternative embodiment.

FIG. 6 is an exploded view of an, electrical connector 148 according to an alternative embodiment. The electrical connector 148 is similar to the electrical connector 22 shown in FIGS. 1-5, and like reference numbers will be used to refer to like elements in both embodiments. The electrical connector 148 includes power contacts 150 that have a somewhat different structure than the power contacts 120 shown in the previous embodiment, such as in FIG. 3. The power contacts 150 are stamped from a blank of sheet material but are not formed. The power contacts 150 are in their final configuration alter stamping. Each contact 150 includes a stamped edge 152 that is defined by a thickness of the material from which the power contact 150 is stamped, and each power contact 150 includes a mating surface 154 that is defined by a major or outer surface of the material from which the power contact 150 is stamped. The mating surface 154 is exposed along a respective side surface 56, 58 of the tongue 50 in the connector housing 42 for engagement with a corresponding power contact of the mating plug 26 (shown in FIG. 1). The mating surface 154 may be larger than the mating surface 132 (shown in FIG. 3) of the power contact 120. Each power contact 150 also has a retention section 156 with retention barbs 158, and a tail 160 for reception in a hole in the circuit board 26 (shown in FIG. 1).

Figure 7:
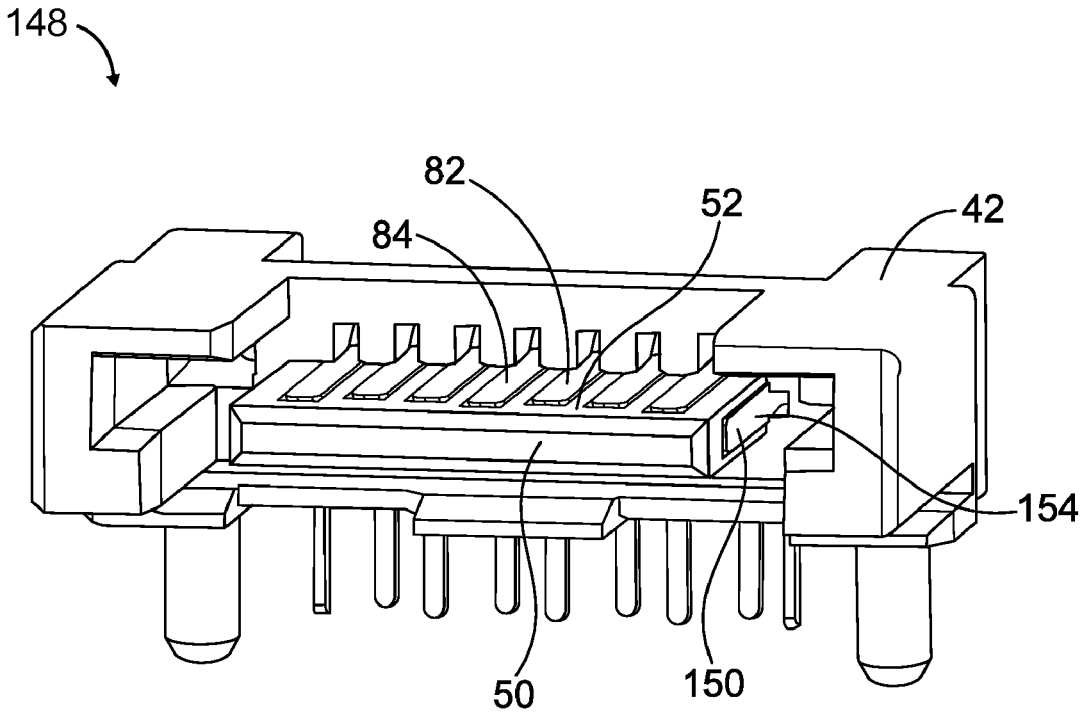
FIG. 7 is an isometric view of the electrical connector shown in FIG. 6.

FIG. 7 is an isometric view of the electrical connector 148 illustrating the power contacts 150 loaded into the housing 42 and extending along the tongue 50. FIG. 7 also illustrates the signal and ground contacts 82, 84 extending along the upper surface 52 of the tongue 50. The mating interface of the electrical connector 148 is substantially similar to the mating interface of the electrical connector 22 (shown in FIG. 2). For example, the tongue 50 has the same dimensions in both embodiments, and the signal and ground contacts 82, 84 are located in similar positions in both embodiments. The power contacts 120, 150 have similar positions in both embodiments, however the size of the mating surfaces 132, 154, respectively, may be different.

Figure 8:
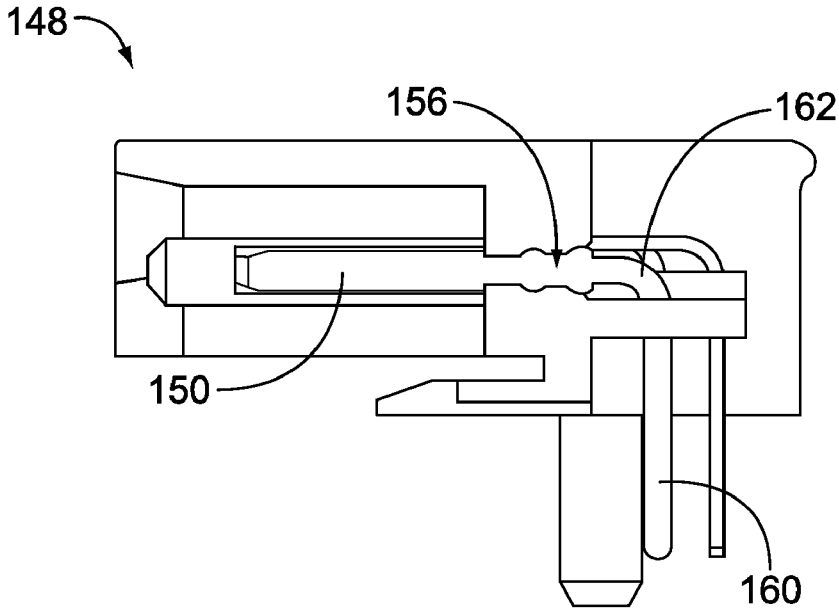
FIG. 8 is a cross-sectional view of the electrical connector shown in FIG. 6.

FIG. 8 is a cross-sectional view of the electrical connector 148 illustrating the power contacts 150 loaded into the housing 42. The power contacts 150 have a transition section 162 between the retention section 156 and a tail 160. The transition section 162 is curved such that the power contact 150 defines a right angle contact. The radius of the transition section 162 is cut from the blank of material during the stamping process, as opposed to being formed by bending process after the power contact 150 is stamped. The power contact 150 is easier to manufacture than contacts manufactured by both a stamping and forming process.

Embodiments of electrical connectors 22, 148 are thus provided that define eSATA connectors. The electrical connectors 22, 148 include signal and ground contacts 82, 84 extending along the upper surface 52 of the tongue 50. Power contacts 120 or 150 are arranged along side surfaces 56, 58 of the tongue 50 that provide power to a cable 16 mated with the electrical connector 22, 148. The cable 16 transmits the power to another device such as an external data storage device. The power contacts 120 or 150 are generally flush with the side surfaces 56, 58 such that the overall size of the mating interface is unaffected by the provision of the power contacts 120 or 150.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions, of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a dielectric housing having a tongue including an upper surface, a lower surface, and opposite side surfaces;

a plurality of signal contacts held by the housing, the plurality of signal contacts having mating surfaces exposed along the upper surface, the mating surfaces being coplanar with one another and the mating surfaces being parallel to the upper surface; and at least one power contact held by the housing and exposed along one of the opposite side surfaces, the at least one power contact being configured to be electrically connected to a power source.

2. The electrical connector of claim 1, wherein the at least one power contact is oriented non-coplanar with respect to the signal contacts.

3. The electrical connector of claim 1, wherein the at least one power contact includes a mating surface arranged substantially flush with the corresponding side surface.

4. The electrical connector of claim 1, wherein the tongue has a width measured between the opposed side surfaces, a first power contact is arranged on one of the side surfaces and a second power contact is arranged on the other side surface, exposed portions of the first and second power contacts are separated by a distance substantially equal to the width of the tongue.

5. The electrical connector of claim 1, wherein the at least one power contact is stamped from a blank to define stamped edges, one of the stamped edges being exposed on the corresponding side surface of the tongue to define a mating surface.

6. The electrical connector of claim 1, wherein the at least one power contact is stamped from a blank having outer surfaces, each power contact being held within the housing such that one of the outer surfaces is exposed along the corresponding side surface to define a mating surface.

7. The electrical connector of claim 1, wherein the tongue and signal contacts define an eSATA mating interface configured for mating with a plug of a serial cable defining an eSATA plug interface.

8. The electrical connector of claim 1, wherein the signal contacts and mating surfaces are arranged substantially flush with the upper surface.

9. The electrical connector of claim 1, wherein the signal contacts are coplanar with one another for substantially the entire exposed length of the signal contacts.

10. The electrical connector of claim 1, wherein the housing includes a base configured to be mounted to a circuit board and the housing includes a main wall extending from the base, the tongue extends from the main wall such that the upper surface is generally parallel to the base.

11. The electrical connector of claim 1, wherein the housing includes a plurality of cavities that receive the signal contacts and the at least one power contact.

12. The electrical connector of claim 1, further comprising ground contacts, the signal contacts being arranged in pairs, each pair being flanked by ground contacts.

13. The electrical connector of claim 1, wherein the tongue has a front tip, ends of the power contact being positioned relatively closer to the front tip than ends of the signal contacts.

14. The electrical connector of claim 1, further comprising a metallic shell surrounding at least a portion of the housing, the shell being configured to engage a portion of a plug mated with the electrical connector.

15. An electrical connector for mating with a serial cable associated with an external data storage device, the serial cable having one or more data conductors and one or more power conductors, the data conductors configured to transmit data to the external data storage device and the power conductors configured to transmit power to the external data storage device, the electrical connector comprising:

a dielectric housing having a tongue including an upper surface and a side surface;

signal contacts exposed along the upper surface of the tongue, the signal contacts having planar mating surfaces that are substantially flush with the upper surface of the tongue, the mating surfaces being configured to be electrically connected to the data conductors of the serial cable;

a power contact exposed along the side surface of the tongue, the power contact being configured to be electrically connected to the power conductor of the serial cable to power the external data storage device; and a metallic shell surrounding at least a portion of the housing, the shell configured to engage a portion of the serial cable.

16. The electrical connector of claim 15, wherein the housing includes side walls separated by a gap, the tongue being positioned within the gap, wherein the shell covers the gap opposite to the signal contacts.

17. The electrical connector of claim 15, wherein the electrical connector includes two power contacts, the power contacts being arranged on two opposed surfaces of the tongue.

18. The electrical connector of claim 15, wherein each of the signal contacts are arranged on a signal plane that bi-sects each signal contact, the electrical connector includes a plurality of power contacts each arranged on a power plane that bi-sects each power contact, the power plane being non-coplanar with the signal plane.

19. An electrical connector comprising:

a dielectric housing having a base configured to be mounted to a circuit board, the housing having a main wall extending from the base and a tongue extending forward from the main wall, the main wall has side walls extending forward from the main wall that flank the tongue, the side walls being separated from one another by a gap that is open above the tongue, the tongue having an upper surface that is generally planar and oriented substantially parallel to the base, and the tongue having side surfaces that are generally perpendicular to the upper surface, the main wall having a plurality of cavities extending therethrough;

a metallic shell coupled to the housing and spanning across the gap between the side walls above the tongue, the metallic shell having grounding fingers extending into the gap, the grounding fingers being configured to engage a plug mated with the electrical connector;

a plurality of signal contacts held by the housing within corresponding cavities, the signal contacts being exposed along the upper surface, the signal contacts having planar mating surfaces positioned at the upper surface of the tongue; and at least one power contact held by the housing within corresponding cavities, the at least one power contact being exposed along one of the opposite side surfaces, the at least one power contact being configured to be electrically connected to a power source.

20. The electrical connector of claim 19, wherein the at least one power contact is non-coplanar with respect to the signal contacts.

21. The electrical connector of claim 19, wherein the housing is open between a majority of the upper surface of the tongue and the metallic shell.

* * * * *